US006827615B2

(12) United States Patent
Axelsson

(10) Patent No.: US 6,827,615 B2
(45) Date of Patent: Dec. 7, 2004

(54) TERMINAL CARRIER CUT-OFF DESIGN

(75) Inventor: Lennart Axelsson, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 94 days.

(21) Appl. No.: 09/872,319

(22) Filed: Jun. 1, 2001

(65) Prior Publication Data

US 2002/0182945 A1 Dec. 5, 2002

(51) Int. Cl.[7] ..... H01R 13/02
(52) U.S. Cl. ..... 439/885; 439/937
(58) Field of Search ..... 439/885, 590, 439/937, 736; 29/884, 882, 879, 747, 751, 753; 83/923, 563, 613, 615, 914, 945; 264/157, 161; 206/715, 716, 820

(56) References Cited

U.S. PATENT DOCUMENTS 2,963,775 A 12/1960 Chadwick
3,082,397 A * 3/1963 Clarkson et al. ..... 439/638
3,550,856 A 12/1970 Wise et al.
4,292,735 A * 10/1981 Thillays ..... 29/854
4,404,744 A 9/1983 Stenz et al.
4,466,692 A * 8/1984 Sonoda ..... 439/730
4,492,023 A * 1/1985 Schneider et al. ..... 29/861
4,753,003 A 6/1988 Gobiel
4,850,905 A 7/1989 Capp et al.
5,428,890 A 7/1995 Zahn
5,544,778 A * 8/1996 Goncalves ..... 220/23.4
5,616,053 A 4/1997 Bogursky et al.
5,725,392 A 3/1998 Bianca et al.
5,957,725 A 9/1999 Bianca et al.
5,975,952 A * 11/1999 McCartin ..... 439/590
6,595,788 B2 * 7/2003 Harper et al. ..... 439/83

* cited by examiner

*Primary Examiner*—Gary Paumen
*Assistant Examiner*—Edwin A. Leon
(74) *Attorney, Agent, or Firm*—Robert A. McCann; Zachary J. Smolinski

(57) ABSTRACT

A terminal disposed on a carrier strip, the terminal including a contact portion and a generally round barrel portion attached to the carrier strip. The barrel portion has a generally squared shoulder where the barrel portion meets the carrier strip. The squared shoulder facilitates completely cutting the terminal from the carrier strip.

7 Claims, 4 Drawing Sheets

TERMINAL CARRIER CUT-OFF DESIGN

BACKGROUND OF THE INVENTION

The present invention pertains generally to terminating wires with terminals, and more particularly to the removal of terminals from a carrier strip during the termination process.

Processes for terminating insulated wires for connecting the wire to electrical apparatus is well-known. The use of a carrier strip to mutually attach and maintain a number of terminals for facilitating their handling and one-by-one sequential removal therefrom for use in a terminating method is also well known, and seen, for example, in U.S. Pat. Nos. 4,404,744, 4,850,905, and 5,428,890. In a typical application, terminals are cut away from the carrier strip and crimped about the end of an insulated wire, in either order, often by a die or other apparatus capable of performing both functions. In order for the terminals to fit over the end of an insulated wire, they typically include a generally cylindrical and dielectric barrel section at the end opposite the electrical contact. Being at the nonconductive end of the terminal, the barrel sections are often used to attach the links of the carrier strip that extend between the terminals.

During the termination process, a die or other apparatus typically employs a cutting blade to separate the terminal being applied from the carrier strip, and typically the blades are applied simultaneously to both sides of a barrel section, thereby cutting both adjacent links of the carrier strip substantially simultaneously. When a terminal on the end of the strip is being used, the second blade is superfluous and the one blade cuts the single adjacent link of the carrier strip.

The dielectric portion of the terminal, which includes the barrel section, is typically fairly deformable. As such, the cutting blades which endeavor to cut away the links of the carrier strip from the terminal sometimes fail to completely cut through, the dielectric material deforming in a manner so as to relieve the concentrated stress of the cutting blade and avoiding complete detachment.

Failure of the blades to completely detach the carrier strip links is a significant manufacturing problem, as it causes down time on an automated assembly line, requires human attention to remove the improperly cut terminal or carrier strip, and requires human attention to place the respective components appropriately to re-initiate the automated assembly process. The frequency of this problem grows as the cutting blades wear and lose their sharpness over a large number of cutting cycles.

SUMMARY OF THE INVENTION

To address the problems caused by a high frequency of incomplete detachment, a new terminal is disclosed. The terminal is disposed on a carrier strip, and the terminal includes a contact portion and a generally round barrel portion attached to the carrier strip. The barrel portion has a generally squared shoulder where the barrel portion meets the carrier strip. The squared shoulder facilitates cutting the terminal completely from the carrier strip.

Also disclosed is a carrier strip integrally connecting and including a plurality of terminals. Each of the plurality of terminals includes a contact portion and a generally round barrel portion attached to said carrier strip. The barrel portion has a generally squared shoulder where the barrel portion meets the carrier strip. The squared shoulder facilitates the complete removal of the terminals from the carrier strip.

Also disclosed is a method for terminating an insulated wire having an insulated portion and exposed end with a terminal from a carrier strip. The terminal includes a contact portion, a generally round barrel portion attached to the carrier strip, the barrel portion including a generally squared shoulder where the barrel portion meets the carrier strip, and an intermediate portion disposed between the contact portion and the barrel portion. The method includes the steps of inserting the insulated wire having an exposed end into the terminal such that the exposed end is inserted substantially into the intermediate portion of the terminal and in electrical contact with the contact portion of the terminal and the insulated portion is inserted substantially into the barrel portion of the terminal; crimping the intermediate portion of the terminal over the exposed end portion of the wire such that the contact between the contact portion of the terminal and the exposed wire portion is maintained; and cutting the terminal from the carrier strip by shearing the barrel portion of the terminal at the generally squared shoulder.

DETAILED DESCRIPTION A PREFERRED EMBODIMENT OF THE INVENTION

Figure 1:
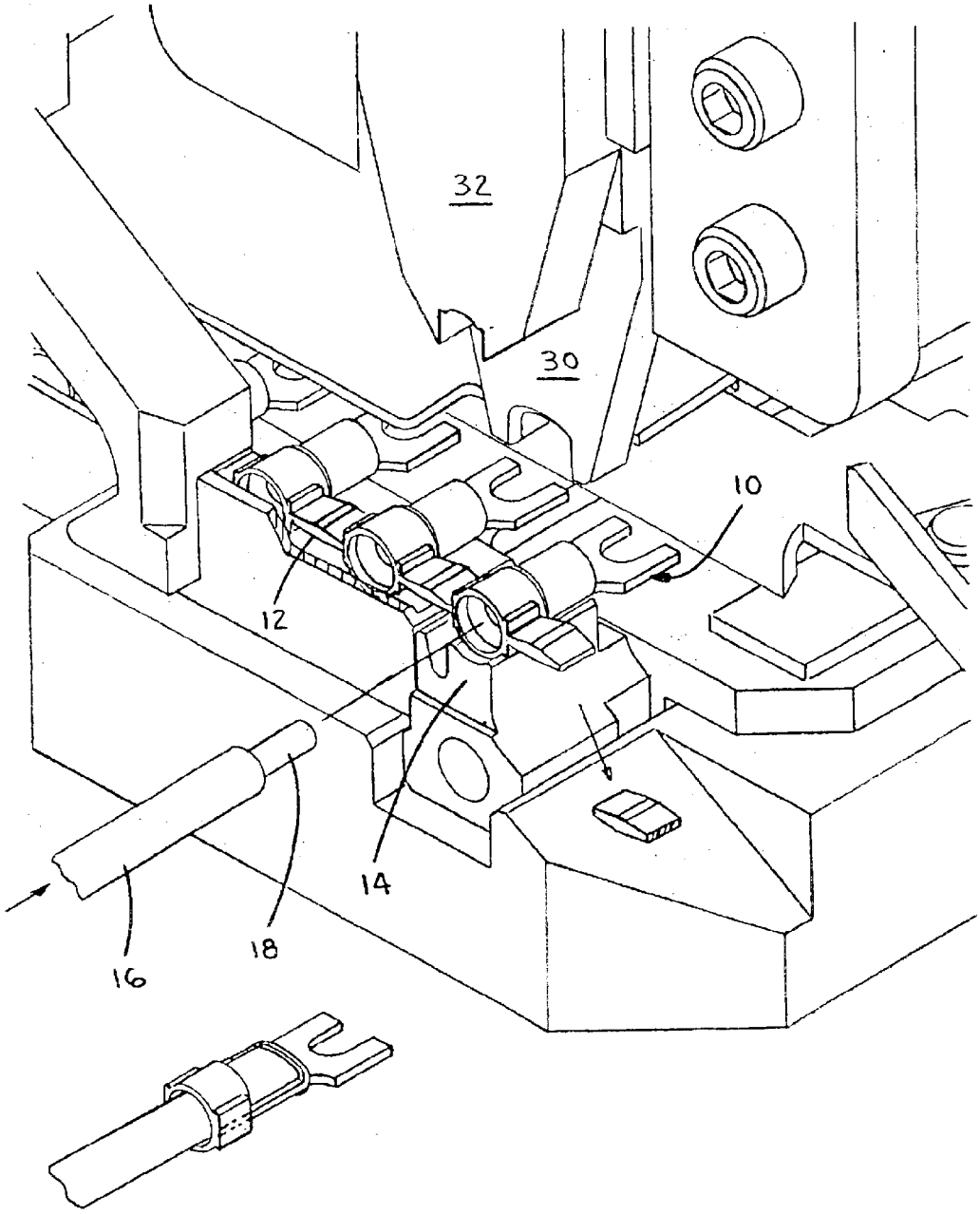
FIG. 1 is a perspective view of the general context of application of the present invention.

In a preferred embodiment of the invention, a number of terminals 10 are generally linearly disposed and attached on a carrier strip 12, shown in context in FIG. 1. The carrier strip 12 is held in a die 14 where individual terminals 10 are sequentially aligned with insulated wires 16 such that the terminals may be crimped over an exposed end 18 thereof.

Figure 2:
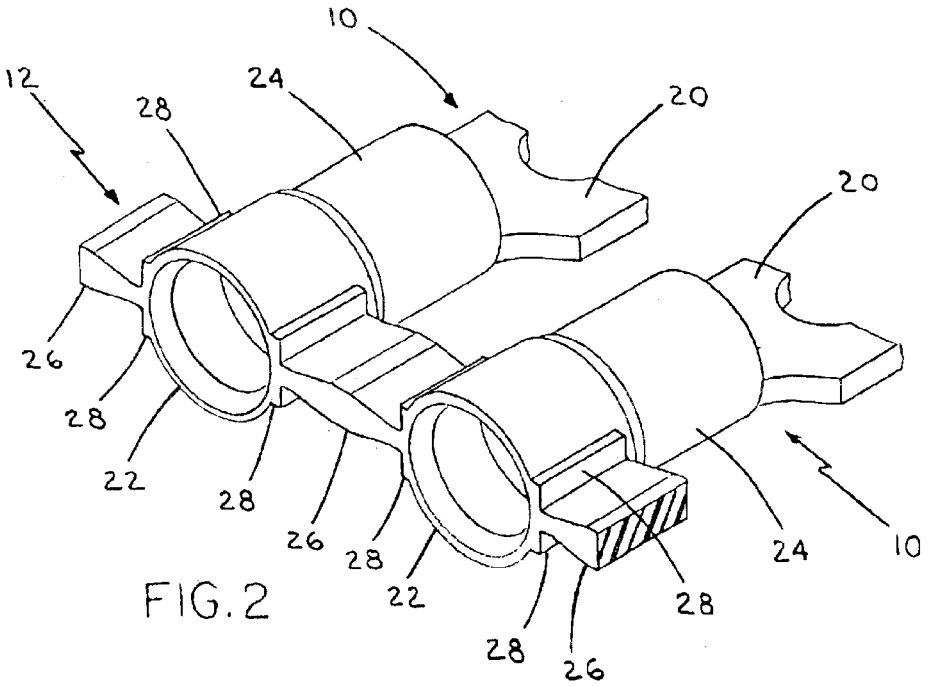
FIG. 2 is a perspective view of a portion of a carrier strip and terminals in accordance with the present invention.

As seen in greater detail in FIG. 2, the terminals 10 each include a contact portion 20 having a conductive property and being suitably shaped for engaging particular electrical connectors or traces, a generally deformable dielectric barrel portion 22 of suitable diameter for fitting over the insulated wire 16, and a dielectric intermediate portion 24 of suitable diameter for fitting over the exposed end 18 of the insulated wire 16. In addition to including the terminals 10, the carrier strip 12 includes links 26 between adjacently disposed terminals.

As further seen in FIG. 2, the barrel portion 22 has one or more shoulder portions 28 integral therewith, the shoulder portions having a generally squared configuration relative to the round barrel portion 22. In a preferred embodiment of the invention, such a shoulder portion 28 is interposed between each barrel portion 22 of a terminal 10 and each adjacent link 26 of the carrier strip 12. Thus, for example, a terminal at the end of a carrier strip may have only one shoulder and adjacent link while a terminal in the middle of the carrier strip may have two shoulders abutting diametrically opposed links.

As can be seen in FIG. 1, the termination process typically involves an insulated wire 16 being stripped of insulation at one end to provide an exposed end 18. When the wire 16 and an individual terminal 10 are properly aligned, the exposed end 18 of the wire is inserted into the terminal such that the exposed end 18 electrically engages the contact portion 20 of the terminal and is generally disposed within the intermediate portion 24 of the terminal. Commonly, the conductive contact portion disposed within the dielectric intermediate portion 24. In this case, the exposed end 18 preferably fits into the cylindrical portion. At this level of insertion, the barrel portion 22 of the terminal generally over wraps the insulated wire 16.

The die preferably has a crimping implement 30 and a cutting implement 32 which are respectively used to crimp the intermediate portion 24 and the cylindrical portion of the contact portion 20 over the exposed end 18 of the wire 16 to maintain the electrical connectivity between the wire and the contact portion 20 of the terminal and then to cut the links 26 of the carrier strip 12 away from the sides of the terminal 10. The crimping and cutting steps may alternatively occur simultaneously or in reverse order within the scope of the invention.

Figure 3A:
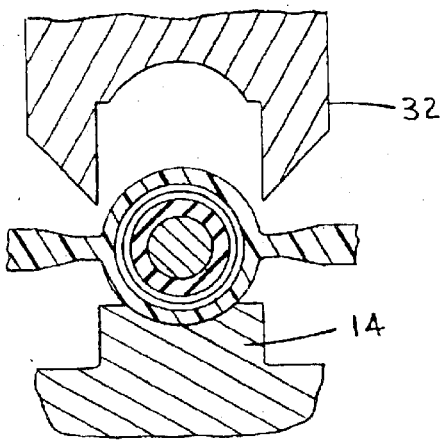
PRIOR ART FIG. 3A
FIGS. 3A and 3B are schematic frontal views of a cutting apparatus being applied to a prior art carrier strip and terminal and a carrier strip and terminal in accordance with an embodiment of the present invention, respectively, wherein the cutting apparatus has not yet engaged the carrier strip.
Figure 3B:
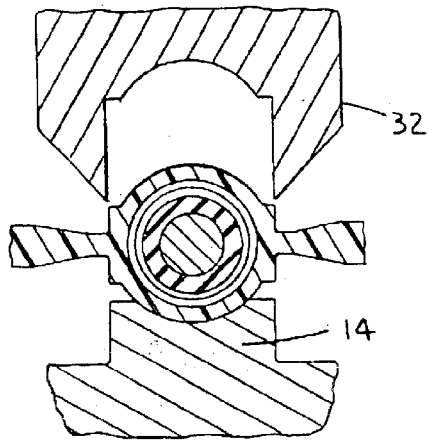
Figure 4A:
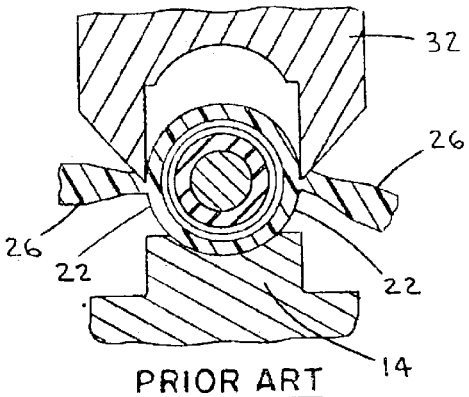
PRIOR ART FIG. 4A
FIGS. 4A and 4B are views akin to those of FIGS. 3A and 3B, respectively, wherein the cutting apparatus has begun to engage the carrier strip.
Figure 4B:
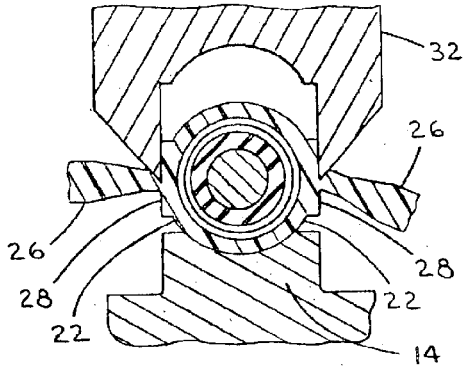
Figure 5A:
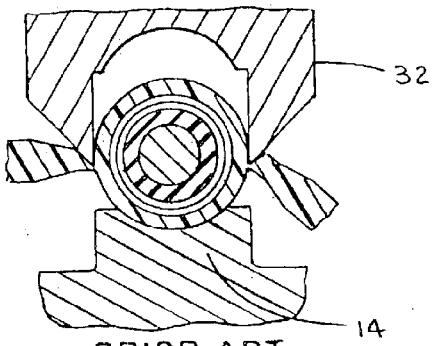
PRIOR ART FIG. 5A
FIGS. 5A and 5B are views akin to those of FIGS. 3A and 3B, respectively, wherein the cutting apparatus has cut a portion of the way through the carrier strip.
Figure 5B:
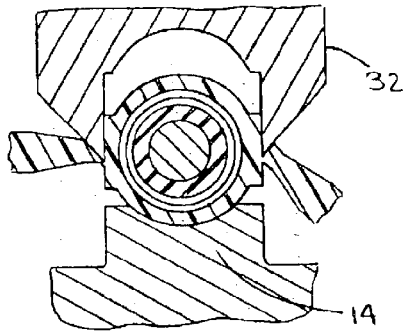
Figure 6A:
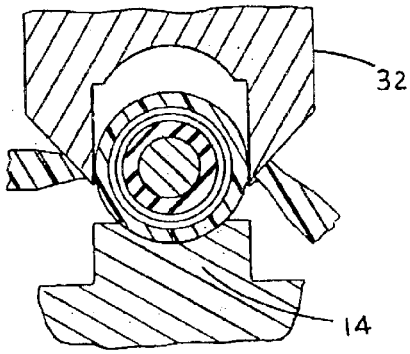
PRIOR ART FIG. 6A
FIGS. 6A and 6B are views akin to those of FIGS. 3A and 3B, respectively, wherein the cutting apparatus has cut substantially all the way through the carrier strip.
Figure 6B:
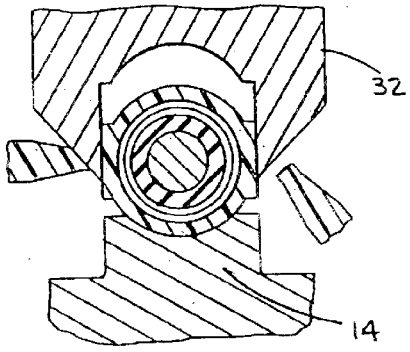
Figure 7B:
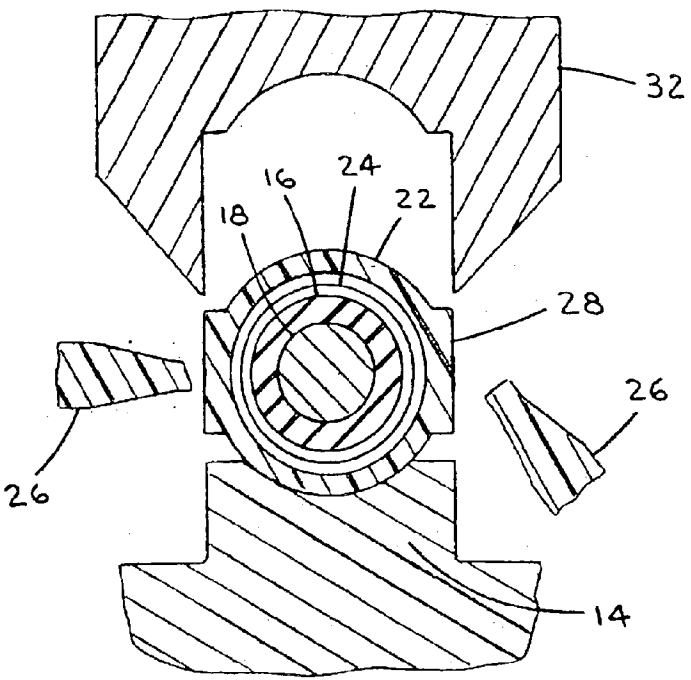
FIGS. 7A and 7B are views akin to those of FIGS. 3A and 3B, respectively, wherein the cutting apparatus has returned to its unengaged position relative to the carrier strip.
Figure 7A:
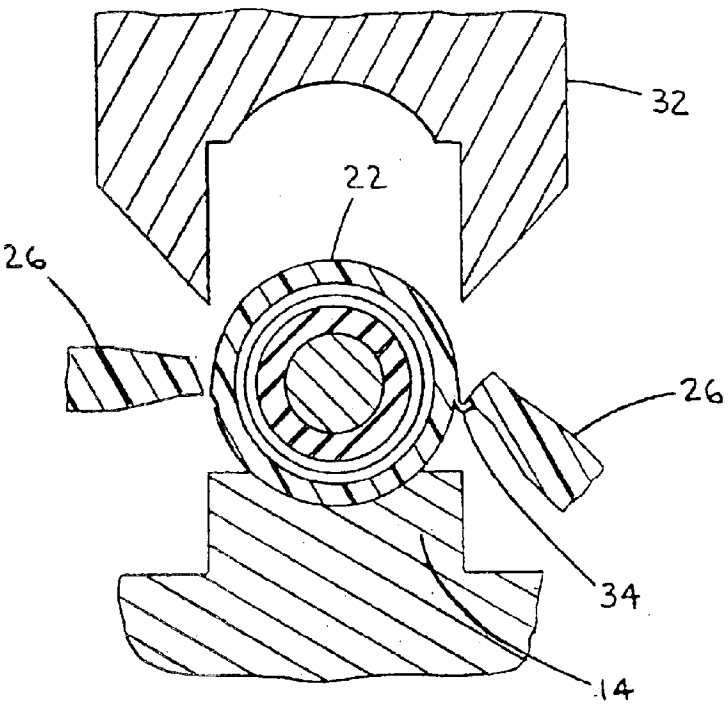
PRIOR ART FIG. 7A

FIGS. 3A, B through 7A, B schematically show an unshouldered prior art terminal (FIGS. 3A–7A) and a shouldered terminal in accordance with an embodiment of the invention (FIGS. 3B–7B) side-by-side at respective points during the cutting process. FIGS. 3A and 3B show the cutting implement, e.g., a pair of blades, just before it is applied to terminals, FIGS. 4A and 4B show the cutting apparatus just beginning to deform the dielectric material between the barrel portion of the terminal and the adjacent links of the carrier strip, FIGS. 5A and 5B show the cutting apparatus in an intermediate stage as it cuts the links away from the terminal, FIGS. 6A and 6B show the cutting implement at a position at which it should have completely severed the links from the terminal, and FIGS. 7A and 7B show the cutting apparatus, terminal, and links after the cutting apparatus has retracted to its initial position in the die. After being completely severed, the link that was adjacent the previously used terminal falls to the ground while the link adjacent the terminal to be used next remains attached to that terminal and the carrier strip generally until the terminal to be used next is cut.

As seen in comparing the unshouldered (prior art) terminal and the shouldered (new) terminal, the sequence of figures, and particularly FIGS. 7A and 7B, show that the deformation of the dielectric material at the connection between the barrel portion and the link may sometimes cause one or both of the links to not become completely severed from the terminal. The incidence of such "hangers" 34 has been considerably reduced by the addition of the squared shoulders in accordance with the invention. The presence of "hangers" is a significant manufacturing problem, as it causes down time on an automated assembly line, requires human attention to remove the improperly cut terminal or carrier strip, and requires human attention to place the respective components appropriately to re-initiate the automated assembly process. The frequency of this problem grows as the cutting implement wears and loses its sharpness over a large number of cutting cycles.

The disclosed invention provides an improved terminal, carrier strip, and method for terminating an insulated wire. It should be noted that the above-described and illustrated embodiments of the invention are not an exhaustive listing of the forms the invention could take; rather, they serve as exemplary and illustrative of preferred embodiments of the invention as presently understood. Many other forms of the invention are believe to exist. The invention is defined by the following claims.

What is claimed is:

1. A terminal disposed on a carrier strip, said terminal comprising:

a contact portion; and a generally round barrel portion attached to said carrier strip, said barrel portion having a generally squared shoulder where said barrel portion meets said carrier strip, said squared shoulder facilitating cutting said terminal completely from said carrier strip.

2. A terminal in accordance with claim 1 wherein said round barrel portion of said terminal is attached to said carrier strip at two distinct points and said generally round barrel portion has a generally squared shoulder at each of said distinct points.

3. A terminal in accordance with claim 1 wherein said terminal further comprises an intermediate portion disposed between said contact portion and said barrel portion.

4. A carrier strip integrally connecting and including a plurality of terminals, each of said plurality of terminals comprising a contact portion and a generally round barrel portion attached to said carrier strip, said barrel portion having a generally squared shoulder where said barrel portion meets said carrier strip, said squared shoulder facilitating the complete removal of said terminals from said carrier strip.

5. A carrier strip in accordance with claim 4 wherein each of said plurality of terminals further comprises an intermediate portion disposed between said contact portion and said barrel portion.

6. A carrier strip in accordance with claim 4 wherein said plurality of terminals are integrally connected with links of said carrier strip and said terminals are arranged on said carrier strip such that there are first and last end terminals with a plurality of intermediate terminals disposed between said end terminals on said carrier strip, wherein each of said end terminals includes a barrel portion having a single generally squared shoulder where said barrel portion meets one of said links of said carrier strip and each of said intermediate terminals includes a barrel portion having a pair of generally squared shoulders generally diametrically opposed on said barrel portion such that each shoulder meets one of said links of said carrier strip.

7. A terminal disposed on a carrier strip, said terminal comprising:

a contact portion; and a generally round barrel portion attached to said carrier strip, said barrel portion having a cutting facilitation portion for facilitating the complete cutting of said terminal from said carrier strip, said cutting facilitation portion comprising two approximately parallel planar surfaces disposed along opposite sides of said generally round barrel portion, said two planar surfaces being adapted to simultaneously guide two cutting blades along said two planar surfaces to effect complete cutting of said terminal from said carrier strip.

* * * * *